US007878223B2

(12) United States Patent
Kroll et al.

(10) Patent No.: US 7,878,223 B2
(45) Date of Patent: Feb. 1, 2011

(54) THROUGH AIR-DRYING FABRIC

(75) Inventors: Lynn Faye Kroll, Sherwood, WI (US); Jeffrey B. Herman, Bala Cynwyd, PA (US); Ronald Bain, Ourimbah (AU)

(73) Assignee: Albany International Corp., Albany, NY (US)

( * ) Notice: Subject to any disclaimer, the term of this patent is extended or adjusted under 35 U.S.C. 154(b) by 699 days.

(21) Appl. No.: 11/406,588

(22) Filed: Apr. 19, 2006

(65) Prior Publication Data

US 2007/0028994 A1 Feb. 8, 2007

Related U.S. Application Data

(60) Provisional application No. 60/673,657, filed on Apr. 20, 2005.

(51) Int. Cl.
*D03D 3/04* (2006.01)
*D21F 7/08* (2006.01)
*D03D 11/00* (2006.01)

(52) U.S. Cl. ..... 139/383 A; 139/383 R; 139/383 AA; 162/358.2

(58) Field of Classification Search ..... 139/383 R, 139/383 A; 162/348, 358.2, 900
See application file for complete search history.

(56) References Cited

U.S. PATENT DOCUMENTS 4,239,065 A * 12/1980 Trokhan ..... 139/383 AA
4,281,688 A * 8/1981 Kelly et al. ..... 139/383 A
4,759,975 A * 7/1988 Sutherland et al. ..... 442/203
RE33,195 E * 4/1990 McDonald et al. ..... 139/425 A
5,089,324 A * 2/1992 Jackson ..... 442/195
5,853,547 A 12/1998 Ahrens et al.
6,237,644 B1 * 5/2001 Hay et al. ..... 139/383 A
6,592,714 B2 7/2003 Lamb
6,649,026 B2 * 11/2003 Lamb ..... 162/348
6,708,732 B1 * 3/2004 Hay et al. ..... 139/383 A
6,743,333 B2 * 6/2004 Lamb ..... 162/116
6,763,855 B2 * 7/2004 Rougvie ..... 139/383 A
6,827,821 B2 * 12/2004 Brewster et al. ..... 162/358.2
6,837,275 B2 * 1/2005 Josef et al. ..... 139/383 A
6,837,276 B2 * 1/2005 Josef et al. ..... 139/383 A
6,860,299 B2 * 3/2005 Kuji ..... 139/383 A
2002/0056536 A1 5/2002 Lamb
2004/0035541 A1 * 2/2004 Lamb ..... 162/348
2004/0102118 A1 * 5/2004 Hay et al. ..... 442/239
2004/0104005 A1 * 6/2004 Brewster et al. ..... 162/358.2
2005/0067039 A1 * 3/2005 LaFond et al. ..... 139/383 A
2005/0167062 A1 * 8/2005 Herman et al. ..... 162/115
2005/0167067 A1 * 8/2005 Crook et al. ..... 162/348
2007/0028994 A1 * 2/2007 Kroll et al. ..... 139/383 R

* cited by examiner

*Primary Examiner*—Bobby H Muromoto, Jr.
(74) *Attorney, Agent, or Firm*—Frommer Lawrence & Haug LLP; Ronald R. Santucci

(57) ABSTRACT

A through-air-drying (TAD) fabric for producing tissue paper and related products on a papermaking machine comprising a plurality of warp yarns interwoven with a plurality of weft yarns to produce a paper-side surface pattern characterized by alternating first pockets and second pockets. The first and second pockets are bounded by raised warp yarns and raised weft yarns produced by knuckles in the fabric pattern. The first pockets are preferably larger in area than the second pockets. The fabric base weave in the interior of the first pocket is preferably a plain weave pattern. The interior of the second pocket may also be bisected by a raised weft yarn.

9 Claims, 8 Drawing Sheets

Paper Side

Machine Side

Machine Side

Paper Side

THROUGH AIR-DRYING FABRIC

CROSS-REFERENCE TO RELATED APPLICATIONS

This application is based upon and claims the benefit of U.S. Provisional Patent Application Ser. No. 60/673,657 filed Apr. 20, 2005 entitled "Fabric for the Production of High Bulk Tissue and Towel and Nonwovens", the disclosure of which is incorporated herein by reference.

BACKGROUND OF THE INVENTION

1. Field of the Invention

The present invention relates to the papermaking arts. More specifically, the present invention relates to through-air-drying (TAD) fabrics used in the manufacture of bulk tissue and towel, and of nonwoven articles and fabrics on a paper machine.

2. Description of the Prior Art

Soft, absorbent disposable paper products, such as facial tissue, bath tissue and paper toweling, are a pervasive feature of contemporary life in modern industrialized societies. While there are numerous methods for manufacturing such products, in general terms, their manufacture begins with the formation of a cellulosic fibrous web in the forming section of a paper machine. The cellulosic fibrous web is formed by depositing a fibrous slurry, that is, an aqueous dispersion of cellulose fibers, onto a moving forming fabric in the forming section. A large amount of water is drained from the slurry through the forming fabric, leaving the cellulosic fibrous web on the surface of the forming fabric.

The cellulosic fibrous web is then transferred to a through-air-drying (TAD) fabric or belt by means of an air flow, brought about by vacuum or suction, which deflects the web and forces it to conform, at least in part, to the topography of the TAD fabric or belt. Downstream from the transfer point, the web, carried on the TAD fabric or belt, passes through a through-air dryer, where a flow of heated air, directed against the web and through the TAD fabric or belt, dries the web to a desired degree. Finally, downstream from the through-air dryer, the web may be adhered to the surface of a Yankee dryer and imprinted thereon by the surface of the TAD fabric or belt, for further and complete drying. The fully dried web is then removed from the surface of the Yankee dryer with a doctor blade, which foreshortens or crepes the web and increases its bulk. The foreshortened web is then wound onto rolls for subsequent processing, including packaging into a form suitable for shipment to and purchase by consumers.

As noted above, there are many methods for manufacturing bulk tissue products, and the foregoing description should be understood to be an outline of the general steps shared by some of the methods. For example, the use of a Yankee dryer is not always required, as, in a given situation, foreshortening may not be desired, or other means, such as "wet creping", may have already been taken to foreshorten the web.

It should be appreciated that TAD fabrics may take the form of endless loops on the paper machine and function in the manner of conveyors. It should further be appreciated that paper manufacture is a continuous process which proceeds at considerable speeds. That is to say, the fibrous slurry is continuously deposited onto the forming fabric in the forming section, while a newly manufactured paper sheet is continuously wound onto rolls after it is dried.

Those skilled in the art will appreciate that fabrics are created by weaving, and have a weave pattern which repeats for flat weaving in both the warp or machine direction (MD) and the weft or cross-machine direction (CD). Woven fabrics take many different forms. For example, they may be woven endless, or flat woven and subsequently rendered into endless form with a seam. It will also be appreciated that the resulting fabric must be uniform in appearance; that is, there are no abrupt changes in the weave pattern that result in undesirable characteristics in the formed paper sheet. Due to the repeating nature of the weave patterns, a common fabric deficiency is a characteristic diagonal pattern in the fabric. In addition, any pattern marking, desired or not, imparted to the formed tissue will impact the characteristics of the paper.

Contemporary papermaking fabrics are produced in a wide variety of styles designed to meet the requirements of the paper machines on which they are installed for the paper grades being manufactured. Generally, they comprise a base fabric woven from monofilament and may be single-layered or multi-layered. The yarns are typically extruded from any one of several synthetic polymeric resins, such as polyamide and polyester resins, used for this purpose by those of ordinary skill in the paper machine clothing arts.

The present application is concerned, at least in part, with the TAD fabrics or belts used on the through-air dryer of a bulk tissue machine. More specifically, the present application is concerned with a TAD fabric of the variety disclosed in U.S. Pat. No. 6,763,855 to Rougvie (which is incorporated herein by reference). Rougvie discloses a TAD fabric comprising a woven base fabric having a coating of a polymeric resin material. Although the present fabric does not have a resin coating, many of the teachings of Rougvie relating to TAD fabrics are relevant.

Fabrics of this kind may also be used in the forming section of a bulk tissue machine to form cellulosic fibrous webs having discrete regions of relatively low basis weight in a continuous background of relatively high basis weight. Belts of this kind may also be used to manufacture other nonwoven articles and fabrics by processes such as hydroentangling, which have discrete regions in which the density of fibers is less than that in adjacent regions.

The properties of absorbency, strength, softness, and aesthetic appearance are important for many products when used for their intended purpose, particularly when the fibrous cellulosic products are facial or toilet tissue, paper towels, sanitary napkins or diapers.

Bulk, cross directional tensile, absorbency, and softness are particularly important characteristics when producing sheets of tissue, napkin, and towel paper. To produce a paper product having these characteristics, a fabric will often be constructed so that the top surface exhibits topographical variations. These topographical variations are often measured as plane differences between strands in the surface of the fabric. For example, a plane difference is typically measured as the difference in height between a raised weft or warp yarn strand or as the difference in height between MD knuckles and CD knuckles in the plane of the fabric's surface. Often, the fabric surface will exhibit pockets in which case plane differences may be measured as a pocket depth.

The present invention provides a TAD fabric which exhibits favorable characteristics for the formation of tissue paper and related products.

SUMMARY OF THE INVENTION

Accordingly, the present invention is a TAD fabric, although it may find application in the forming, pressing and drying sections of a paper machine. As such, it is a papermaker's fabric which comprises a plurality of warp yarns interwoven with a plurality of weft yarns.

The present invention is preferably a TAD fabric comprising a plurality of warp yarns interwoven with a plurality of weft yarns to produce a paper-side surface pattern characterized by alternating first pockets and second pockets. The first and second pockets are bounded by raised warp yarns and raised weft yarns produced by knuckles in the fabric pattern. The first pockets are preferably larger in area than the second pockets. The fabric base in the interior of the first pocket is preferably a plain weave pattern. The interior of the second pocket may also be bisected by a raised weft yarn.

The present invention will now be described in more complete detail with frequent reference being made to the drawing figures, which are identified below.

BRIEF DESCRIPTION OF THE DRAWINGS

For a more complete understanding of the invention, reference is made to the following description and accompanying drawings, in which.

DETAILED DESCRIPTION OF THE PREFERRED EMBODIMENTS

The present invention is preferably a TAD fabric having at least two different sized pockets which alternate on the paper-side surface. The pocket sizes are a function of the weave pattern, mesh count, and yarns used in the pattern. Pocket sizes can be characterized by an MD/CD dimension and/or by a pocket depth. The pockets are formed/bounded by weft yarns and warp yarns which are raised from the base plane of the fabric surface. The raised weft yarns and warp yarns are produced by long knuckles in the weave pattern. The fabric base weave inside each pocket can be a plain weave pattern or any other suitable pattern. In addition, a pocket may include one or more raised or semi-raised warp yarns or weft yarns inside the pocket perimeter. For example, one size pocket may have a raised weft yarn bisecting the pocket area.

Fabrics according to the present invention may have mesh/end counts in the range of 12-20 yarns/cm in the MD and 10-18 yarns/cm in the CD. The pocket depth of the present fabrics may range between 300 and 500 μms.

Advantages of the present fabric are a relatively high percentage of open area resulting in a high air permeability as compared to other TAD fabrics. The present fabric produces a distinct and visible pattern in the tissue paper while limiting manufacturing stresses to maintain tensile strength and prevent ruptures. As a result, the present fabric may reduce or not cause pinholes in the tissue paper, as seen with other highly structured TAD fabrics.

A preferred embodiment of the present fabric may be produced with a 10-shed pattern comprising 3 different warp yarn contours and 3 different weft yarns contours. This pattern forms two sizes of pockets (or depressions) on the fabric surface. The smaller pocket encompasses an area which is between 45% and 65% of the area encompassed by the larger pocket. Both the large and small pockets are surrounded by higher out of plane long knuckles created by warp yarns and weft yarns. The interior of the large pocket has a plain weave surface pattern. The interior of the small pocket is bisected by a raised weft yarn across its center. This raised weft yarn may or may not be in-plane with the high long knuckles forming the pocket. Other embodiments alternatively may have a raised warp yarn bisecting the pocket.

Figure 1:
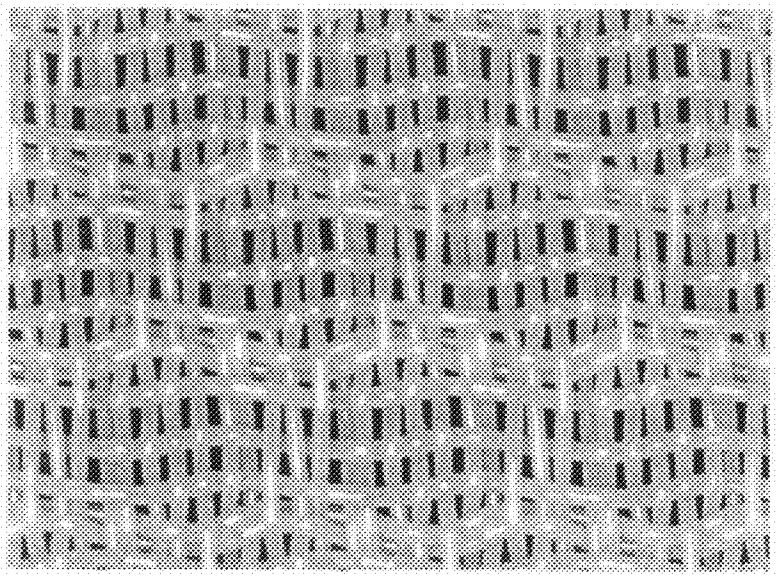
FIG. 1 shows a paper side view and a machine side view illustrating the paper side and machine side surface weave patterns for a preferred embodiment of the present invention.
Figure 1:
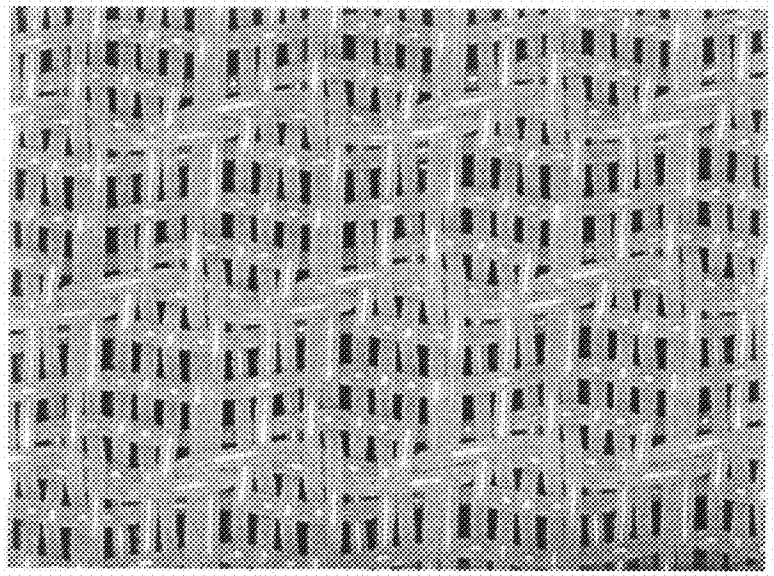

FIG. 1 shows a paper side view and a machine side view illustrating the paper side and machine side surface weave patterns for the preferred embodiment of the present invention. In this preferred embodiment all MD yarns are 0.35 mm in diameter and all CD yarns are 0.40 mm in diameter. The mesh count is 18.9 yarns/cm in the MD and 13.0 yarns/cm in the CD. The pocket depth for this fabric is approximately 430-440 μms. This pattern also has shute runners on the machine side of the present fabric for abrasion resistance.

Figure 2:
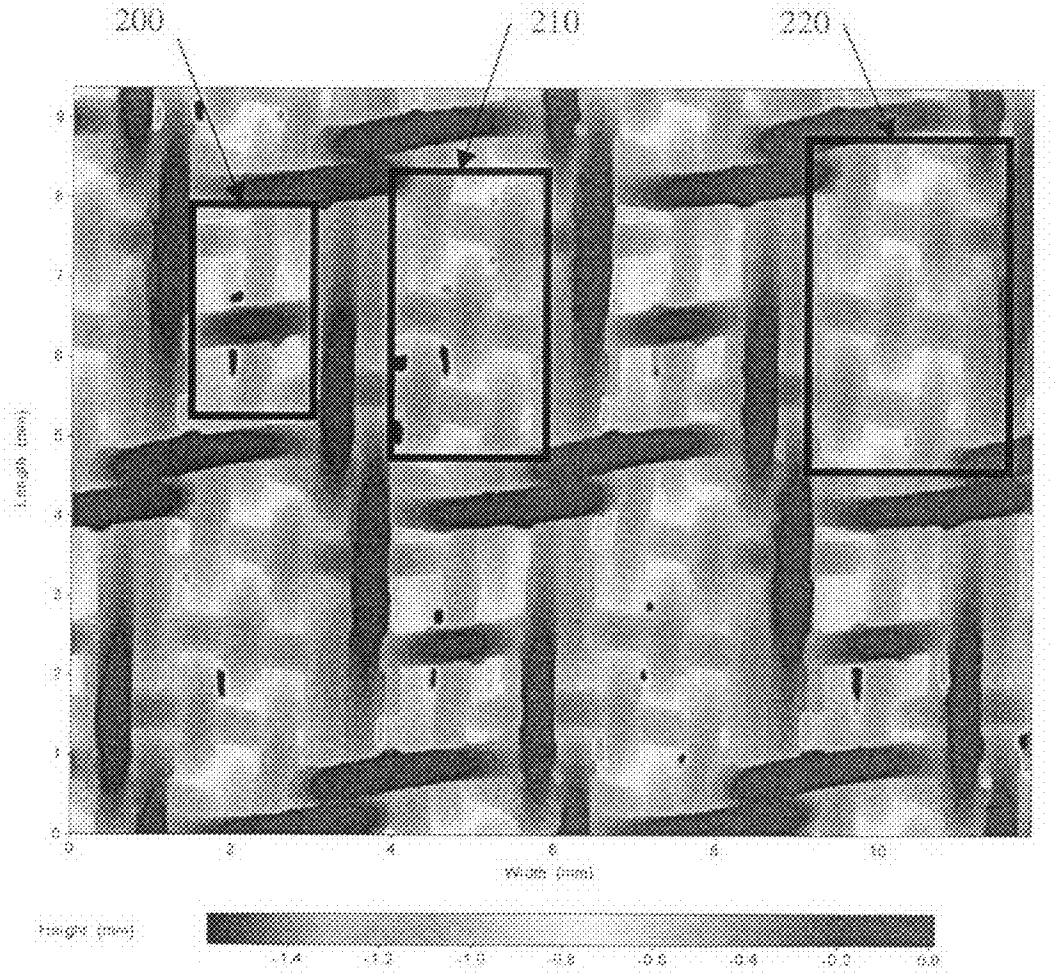
FIG. 2 is a surface depth view highlighting the relative pocket sizes on the paper side surface of the fabric shown in FIG. 1.

FIG. 2 is a surface depth view of the preferred embodiment taken with a MarSurf TS 50 high-precision optical 3D measuring instrument manufactured by Mahr GmbH Gottingen, Gottingen, Germany, and the relative pocket sizes on the paper side surface are highlighted. FIG. 2 provides a close-up view of the paper side surface shown in FIG. 1. The fabric shown in FIG. 2 has two different sized pockets: a small pocket 200 and a large pocket 210, 220. The small pocket 200 has an area of approximately 4.03 $mm^2$. The large pocket has a minimum area measurement of 7.84 $mm^2$ (as shown by highlighted pocket 210) and a median area measurement of 10.52 $mm^2$ (as shown by highlighted pocket 220).

Figure 3:
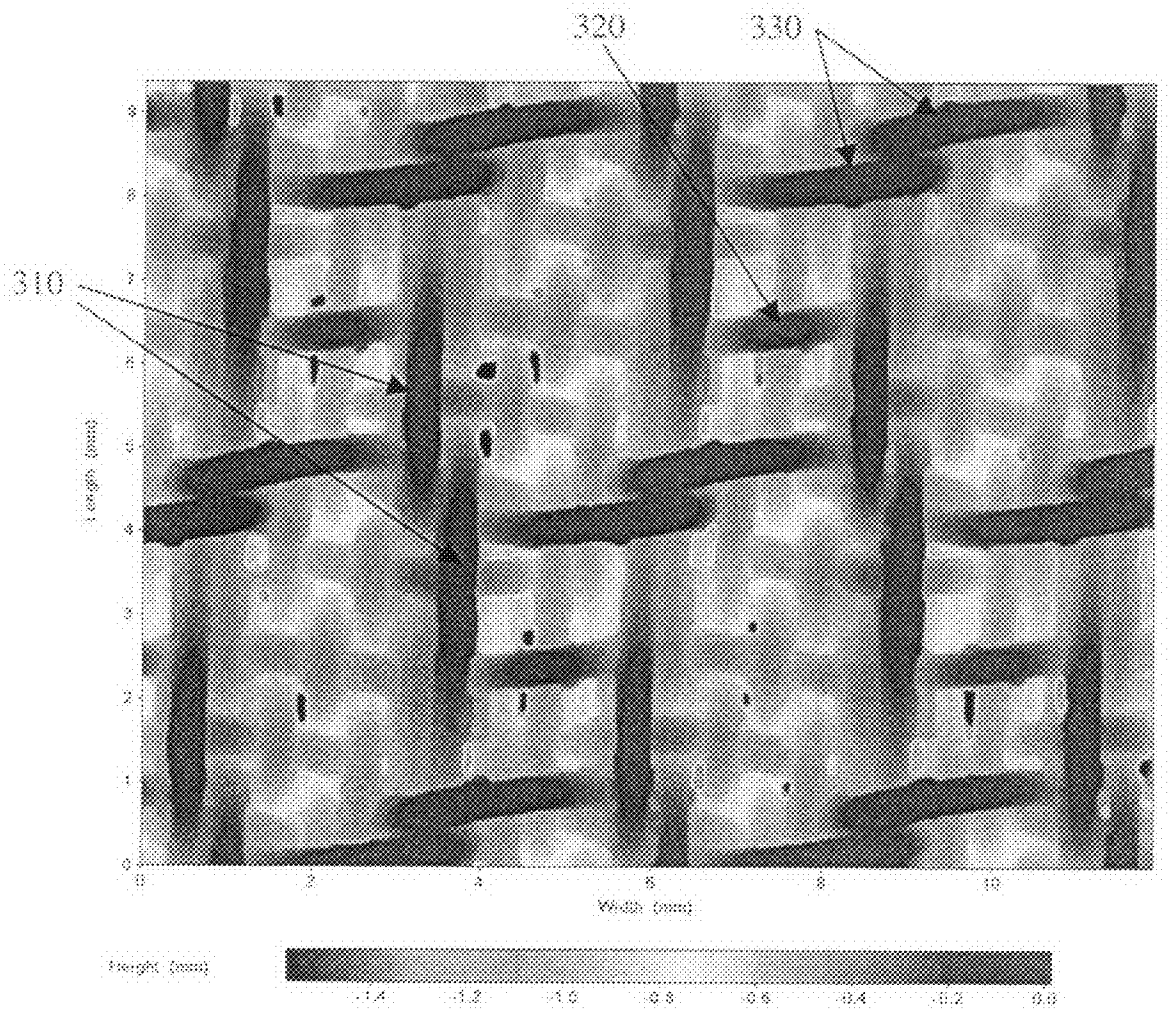
FIG. 3 is a surface depth view highlighting the raised wefts and warps in the paper side surface of the fabric shown in FIG. 1.

FIG. 3 is a surface depth view of the preferred embodiment also taken with a MarSurf TS 50 high-precision optical 3D measuring instrument manufactured by Mahr GmbH Gottingen, Gottingen, Germany, showing the raised wefts and warps on the paper side surface. The pockets are formed/bounded by raised weft yarns 330 and raised warp yarns 310. Note the interiors of the large pockets have a plain weave pattern, while the interiors of the small pockets have a raised weft yarn 320 which bisects the pocket. This raised weft yarn 320 may or may not be in the same plane as the raised weft yarns and warp yarns which bound the pockets.

Figure 4:
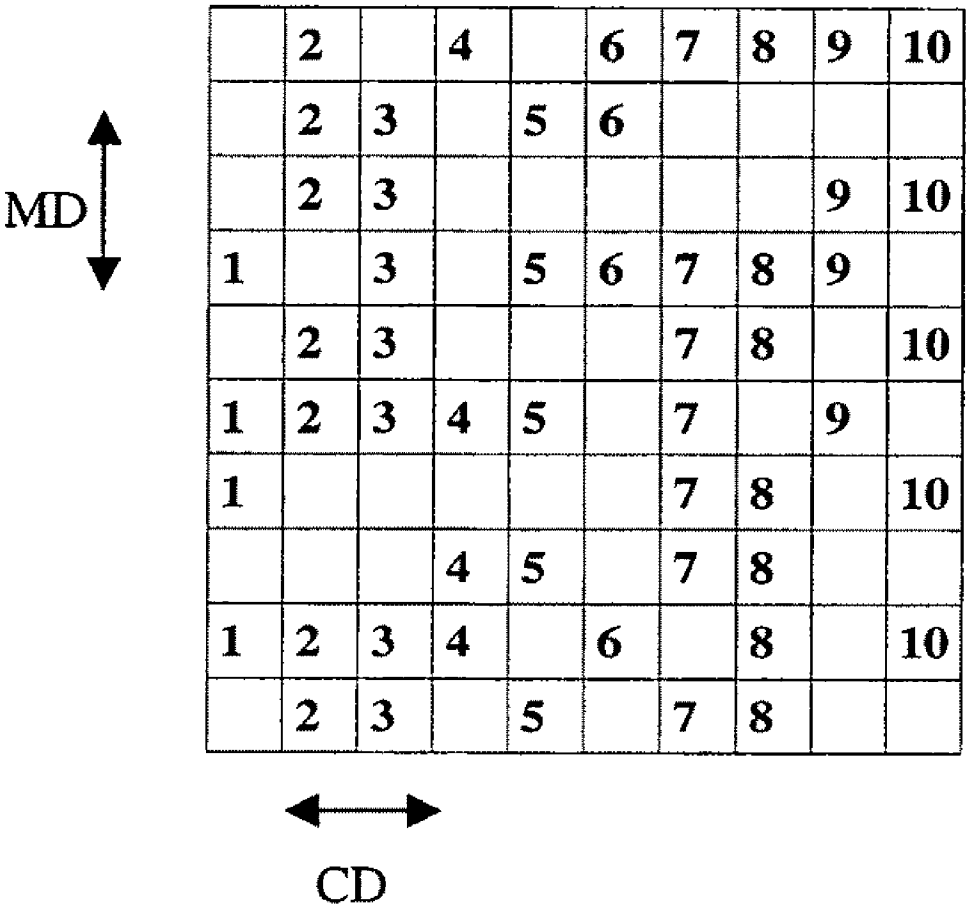
FIG. 4 is a schematic plan view of the paper side surface weave pattern for the fabric shown in FIG. 1.

FIG. 4 is a schematic plan view of the paper side surface weave pattern for the fabric shown in FIG. 1. In FIG. 4, the MD runs vertically and the CD runs horizontally. Each column corresponds to a warp yarn and each row corresponds to a weft yarn. The numbered boxes indicate knuckles where that numbered warp yarn is on the top (paper) surface of the fabric. Accordingly, the empty boxes indicate locations where a warp yarn passes under a weft yarn.

Figure 5:
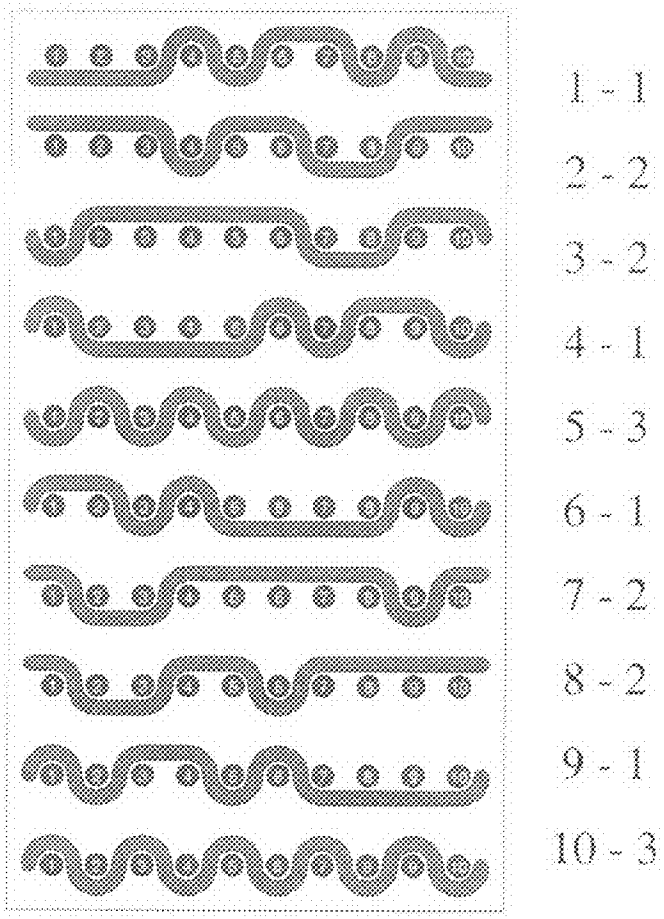
FIG. 5 shows the warp yarn contour patterns for the fabric pattern shown in FIG. 4.

FIG. 5 shows the warp yarn contour patterns for the fabric pattern shown in FIG. 4. The numbers to the right of each warp yarn contour pattern indicate the number of the warp yarn followed by the contour pattern number for that warp yarn. For example, warp yarns 1, 4, 6, and 9 each weave a staggered/shifted version of contour pattern number 1. Note, the present fabric pattern incorporates 3 different warp yarn contours in a 1, 2, 2, 1, 3 sequence which repeats twice in one pattern repeat. Each warp yarn corresponds to a column in FIG. 4. For example, warp yarn 1 corresponds to the pattern shown in the first column in FIG. 4. As shown by the contour pattern for warp yarn 1, the warp yarn passes under weft yarns 1-3, over weft yarn 4, under weft yarn 5, over weft yarns 6 and 7, under weft yarn 8, over weft yarn 9, and under weft yarn 10. Accordingly, in column 1 of FIG. 4, the boxes corresponding to weft yarns 4, 6, 7, and 9 indicate that warp yarn 1 forms knuckles where it passes over the weft yarns in the contour pattern. Alternatively, the boxes in FIG. 4 are blank where the warp yarn passes under the weft yarn.

Figure 6:
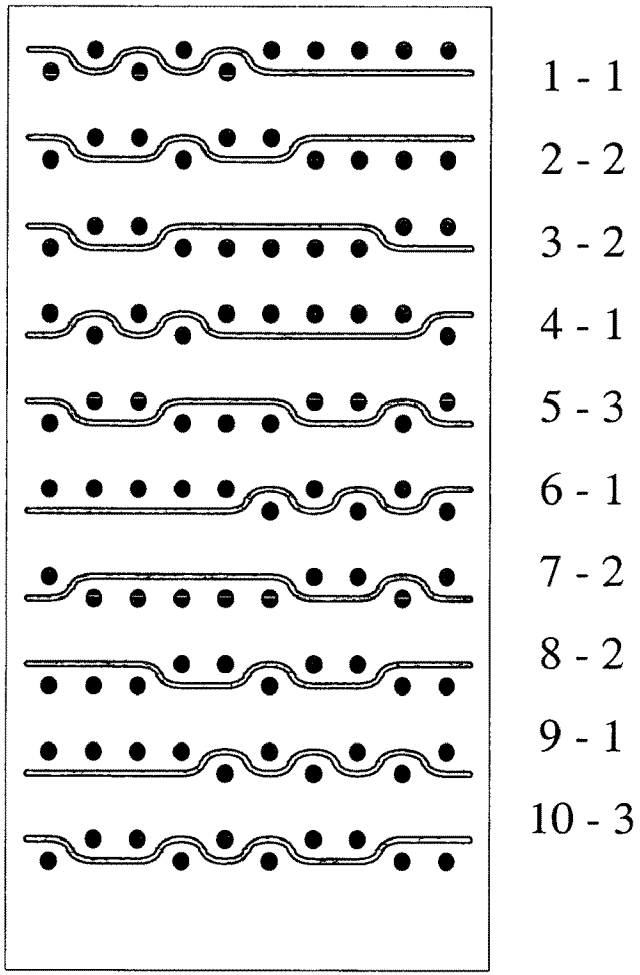
FIG. 6 shows the weft yarn contour patterns for the fabric pattern shown in FIG. 4.

FIG. 6 shows the weft yarn contour patterns for the fabric pattern shown in FIG. 4. As in FIG. 5, the numbers to the right of each weft yarn contour pattern indicate the number of the weft yarn followed by the contour pattern number for that weft yarn. For example, weft yarns 1, 4, 6, and 9 each weave a staggered/shifted version of contour pattern number 1. Note, the present fabric pattern incorporates 3 different weft yarn contours in a 1, 2, 2, 1, 3 sequence which repeats twice in one pattern repeat. Each weft yarn corresponds to a row in FIG. 4. For example, weft yarn 1 corresponds to the pattern shown in the first row in FIG. 4. As shown by the contour pattern for weft yarn 1, the weft yarn passes over warp yarn 1, under warp yarn 2, over warp yarn 3, under warp yarn 4, over warp yarn 5, and under warp yarns 6-10. Accordingly, in row 1 of FIG. 4, the boxes corresponding to warp yarns 2, 4, and 6-10 indicate those warp yarns form knuckles where they pass over weft yarn 1 in the contour pattern. As above, the boxes in FIG. 4 are blank where the warp yarn passes under the weft yarn.

Figure 7:
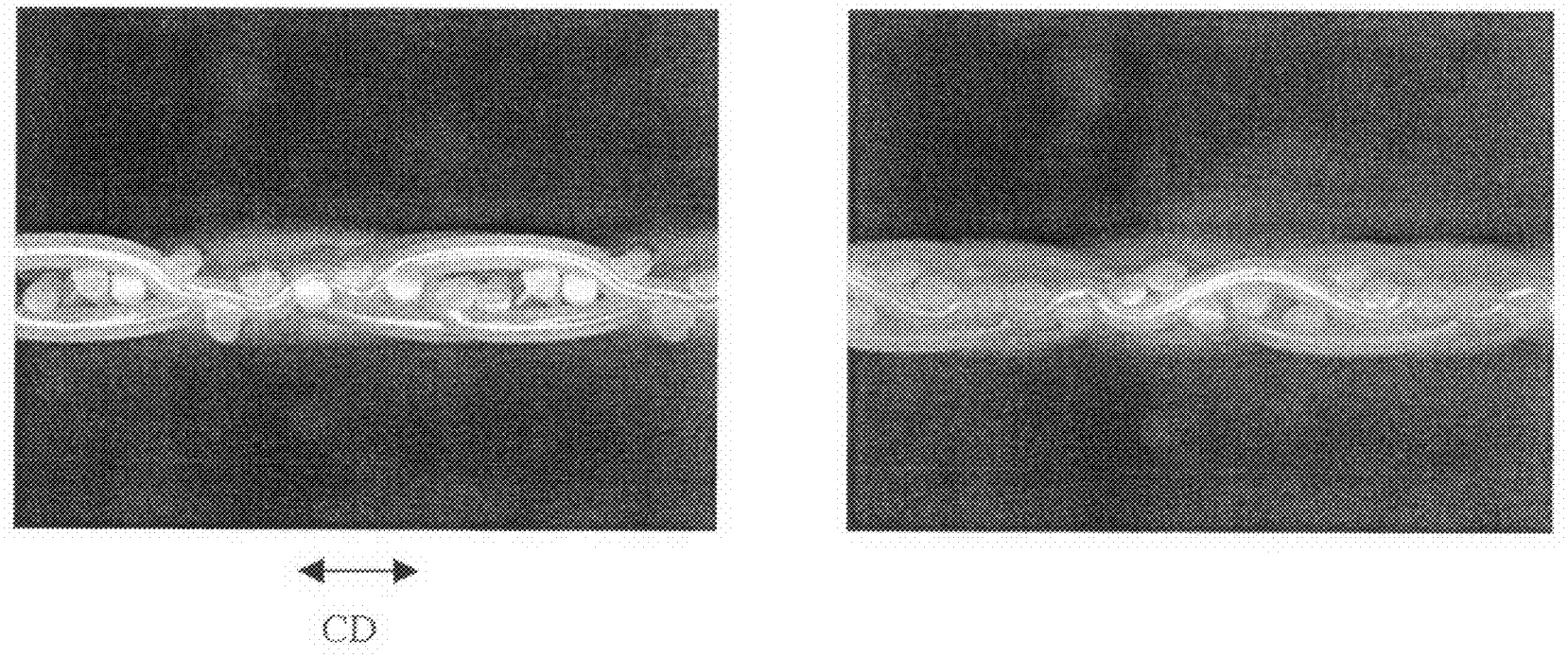
FIG. 7 shows cross-sectional views in the CD illustrating different weft yarn contour patterns for the fabric shown in FIG. 1.
Figure 8:
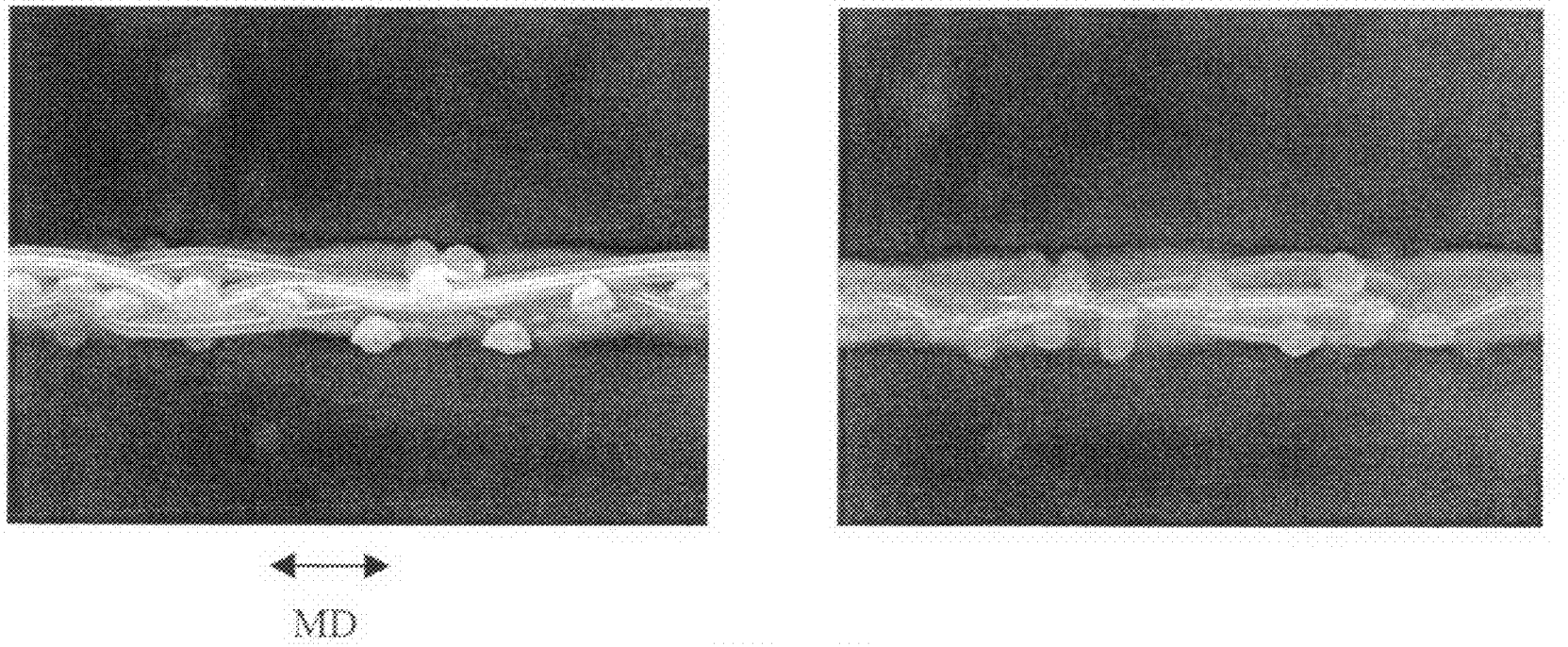
FIG. 8 shows cross-sectional views in the MD illustrating different warp yarn contour patterns for the fabric shown in FIG. 1.

FIG. 7 shows cross-sectional views in the CD illustrating two of the three different weft yarn contour patterns for the fabric shown in FIG. 1. FIG. 8 shows cross-sectional views in the MD illustrating two of the three different warp yarn contour patterns for the fabric shown in FIG. 1.

The present invention is intended to cover other fabric patterns having different sizes and shapes of pockets, different pocket depths, and different yarn contours. Accordingly, the present invention should not be construed as being limited to the preferred embodiment disclosed above.

The fabric according to the present invention preferably comprises only monofilament yarns, preferably of polyester, polyamide, or other polymers. Any combination of polymers for any of the yarns can be used as identified by one of ordinary skill in the art. The CD and MD yarns may have a circular cross-sectional shape with one or more different diameters. For example, the raised weft yarns and warp yarns may be a different diameter than the weft yarns and warp yarns forming the base fabric (i.e. the pocket interiors). The weft yarn and warp yarn diameters may range from 0.20 mm to 0.55 mm, and are preferably between 0.35 mm and 0.45 mm. However, any combination of diameters can be used and these exemplary diameters should not be construed as limiting the invention in any way. Further, in addition to a circular cross-sectional shape, one or more of the yarns may have other cross-sectional shapes such as a rectangular cross-sectional shape or a non-round cross-sectional shape.

Modifications to the above would be obvious to those of ordinary skill in the art, but would not bring the invention so modified beyond the scope of the present invention. The claims to follow should be construed to cover such situations.

What is claimed is:

1. A through-air-drying (TAD) fabric for use on a papermaking machine, comprising:

a plurality of warp yarns interwoven with a plurality of weft yarns to produce a paper-side surface pattern having alternating first pockets and second pockets;

wherein the first pockets are larger in area than the second pockets; and wherein the first and second pockets are bounded by raised warp yarns and raised weft yarns produced by long knuckles in the paper-side surface pattern, wherein a fabric base weave in the interior of the second pocket is bisected by a raised weft yarn across the center of the second pocket.

2. The TAD fabric according to claim 1, wherein a fabric base weave in the interior of the first pocket is a plain weave pattern.

3. The TAD fabric according to claim 1, having a 10-shed weave pattern comprising 3 different warp yarn contours and 3 different weft yarn contours.

4. The TAD fabric according to claim 1, wherein the area of the second pocket is between 45% and 65% of the area of the first pocket.

5. The TAD fabric according to claim 1, wherein a machine-side surface weave pattern has shute runners for abrasion resistance.

6. The TAD fabric according to claim 1, wherein at least some of the plurality of warp yarns and the plurality of weft yarns are one of polyamide yarns or polyester yarns.

7. The TAD fabric according to claim 1, wherein the TAD fabric is a single layer weave fabric.

8. The TAD fabric according to claim 1, wherein at least some of the plurality of warp yarns and the plurality of weft yarns have one of a circular cross-sectional shape, a rectangular cross-sectional shape and a non-round cross-sectional shape.

9. The TAD fabric according to claim 1, wherein at least some of the plurality of warp yarns or the plurality of weft yarns are monofilament yarns.

* * * * *